United States Patent [19]

Bröllos

[11] 4,342,409

[45] Aug. 3, 1982

[54] DEVICE FOR PRESSING PANTS

[76] Inventor: Günther Bröllos, Sonnenstrasse 72, 8804 Dinkelsbühl, Fed. Rep. of Germany

[21] Appl. No.: 211,174

[22] Filed: Nov. 28, 1980

[30] Foreign Application Priority Data

Dec. 4, 1979 [DE] Fed. Rep. of Germany ..... 2948714

[51] Int. Cl.[3] ..... D06F 71/28

[52] U.S. Cl. ..... 223/73; 223/74

[58] Field of Search ..... 223/72, 73, 74; 38/12, 38/14–16

[56] References Cited

U.S. PATENT DOCUMENTS

| | | | |
|---|---|---|---|
| 2,685,990 | 8/1954 | Glover | 223/73 |
| 2,759,644 | 8/1956 | Forse et al. | 223/73 |
| 2,908,427 | 10/1959 | DeFino et al. | 223/73 |
| 3,144,969 | 8/1964 | Kannegiesser et al. | 223/74 |
| 3,405,853 | 10/1968 | Carpexiter et al. | 223/74 |
| 3,823,854 | 7/1974 | Everett | 223/73 |

FOREIGN PATENT DOCUMENTS

| | | | |
|---|---|---|---|
| 2202036 | 3/1973 | Fed. Rep. of Germany | 223/72 |
| 2063928 | 6/1981 | United Kingdom | 223/73 |

*Primary Examiner*—Louis Rimrodt
*Attorney, Agent, or Firm*—Holman & Stern

[57] ABSTRACT

In a device for pressing pants whereby the pants are oriented vertically, it is desired that the human operation of the device be confined to one side, and that the pants can be inserted in the device in simple fashion, from only the front side of the device. This is achieved in an arrangement wherein, with reference to FIG. 1, two vertical front press plates (8 and 9) and two insertion plates (6 and 7) are hinged (18 and 19) to swing outward in flap fashion with respect to two vertical rear press plates (4and 5), such hinging being to the rear press plates (4and 5); wherein pressing assemblies (23) for pressing the pairs of press plates together are disposed outside the swing region of the front press plates (8 and 9) and the insertion plates (6 and 7); wherein for tensioning the pants one rear press plate (5) is made horizontally translatable (per 11 and 17) with respect to the other rear press plate (4); and wherein a clamp (25) for holding and stretching the waistband is associated with the broad side of one rear press plate (4), which broad side is furnished with nozzle openings (37). When the front press plates and the insertion plates are swung open, the broad sides of the rear press plates (which broad sides are furnished with nozzle openings) as well as the clamp which is holding the front end of the waistband, are freely accessible from the front side of the device. After the waistband is held fast and tensioned, the pants are pressed between the press plates, after which the two pairs of press plates are moved apart a little, horizontally in the plane of the pants, in order to tension the pants.

10 Claims, 3 Drawing Figures

DEVICE FOR PRESSING PANTS

BACKGROUND OF THE INVENTION

1. Field of the Invention

The invention concerns a device for pressing pants, wherein means comprising a clamp and a freely extending tensioning finger are provided on an upper crossarm, for holding and stretching the waistband, and underneath there are two pairs of vertically running press plates which in the closed state face each other in pairs with their broad sides furnished with nozzle openings and which accommodate intermediate insertion plates in the pairs, and wherewith there are provided pressing units or assemblies for pressing the press plates against each other in pairs, and a mechanism for tensioning the pants by translating plates in the horizontal direction with respect to each other.

2. Description of the Prior Art

In a known device of this type (see German OS No. 22 50 640) the two press plates of each pair are disposed at a distance apart and are not movable in the horizontal direction parallel to the plane of the held pants. With each of the press plates there is associated a pressing assembly in the form of a piston and cylinder mechanism which can press said press plate against the intermediately disposed insertion plate. The two insertion plates are translatable with respect to each other in the horizontal direction in the plane of the pants and may be moved out together between the two pairs of press plates. The tensioning of the pants occurs in the horizontal direction in the plane of the pants, so as to be better able to iron the seams of the pants. The moving out is necessary in order to be able to mount the pants for pressing.

Thus, when mounting the pants for pressing, the operator must work both on the front and the back of the device. Specifically, the pants must be inserted with the waistband in a clamp at the front of one insertion plate and in another clamp at the back of that insertion plate. For tensioning the pants, rods must be introduced into the pants legs from the bottom, which rods are disposed not on the front but on the back of the insertion plates. Accordingly, the insertion of the pants into the device is time-consuming and complicated.

SUMMARY OF THE INVENTION

Thus, one underlying problem of the present invention was to devise a device of the type described initially supra, which only needs to be attended from the front, in simple fashion, and with which device the pants are inserted only from the front, in simple fashion. To solve this problem, the present invention affords the following. Two front press plates and two insertion plates which are hinged to swing outward in flap fashion with respect to the back press plates, the hinges being located on the back press plates. The pressing assemblies are disposed outside the swing region of the front press plates and the insertion plates. For tensioning the pants, one back press plate is made horizontally translatable with respect to the other back press plate, and a clamp is associated with the broad side of the wider press plate.

When the device is open, that is, when the front press plates and the insertion plates are swung out, the broad sides of the lower press plates (which are provided with nozzle openings), are accessible, without any pressing assemblies being in the way. The clamp for holding the front end of the waistband is accessible from the front without interference from any press plate or insertion plate. After the waistband is grasped and stretched, the pants are pressed between the press plates, following which the two pairs of press plates are moved a little apart in the horizontal direction in the plane of the pants, for the purpose of tensioning the pants. It is thus unnecessary to hold the legs of the pants with rods, which would necessitate working on the back side of the device, as in the prior art.

The inventive device is also of a generally smaller construction than the prior art, which results in lower cost. One reason for the smaller construction is dispensing with translatability of the plates in the horizontal direction in the process of opening the device; another reason is that only two press plates must be moved for the pressing, hence pressing assemblies are needed for only two press plates. The rear press plates are mounted immovably with respect to the pressing direction, and are kept relatively narrow, since the width of the pants is provided for by shifting one of the rear press plates. By means of the shifting of this one rear press plate, the positions of the associated insertion plate and the associated front press plate are also adjusted to the width of the pants at the same time.

It is particularly advantageous if the bottom end of the translatable press plate extends into a slot in the base of the frame and is connected to a piston and cylinder assembly which is disposed in the base of the frame. In this way, the piston and cylinder assembly required for the shifting of the rear press plate does not interfere with the accessibility of the device when opened.

It is also particularly advantageous if each front press plate projects out over the hinges with an extension section, whereby the pressing assembly is attached on the one hand to the rear press plate and on the other hand engages said extension section. Under this arrangement, the pressing assemblies are disposed behind the press plates; hence accessiblity during the closed state of the device is achieved by very simple means. It is not necessary, in order to flip open the front press plates, to move away pressing assemblies disposed on the front side of the device.

It is additionally particularly advantageous if the translatable rear press plate is supported on a carriage which is mounted on the crossarm so as to be movable in the horizontal direction, with the support of said press plate being via an intermediate piece. This constitutes a simple and space-saving arrangement for effecting translatability and adjustability of the one rear press plate.

It is further particularly advantageous if the tensioning finger works in concert with the intermediate piece and the translatable rear press plate, while the clamp works in concert with the other rear press plate. This simplifies the construction design, since here the two moving parts—the tensioning finger and the adjustable rear press plate—are separated from the other parts—namely, the clamp and the second rear press plate.

Given this, it is further particularly advantageous if the clamp comprises the one rear non-moving press plate and a clamping finger which moves with respect to said plate. In this way, the holding of the folded front end part of the waistband is accomplished with only one clamp; this folded part is of a fourfold thickness, and thus is very thick. No additional clamps are located on the rear side of the press plate.

Although under some circumstances it may be advantageous for both rear press plates to be movably mounted, it is in general, particularly advantageous for the second rear press plate to be immovably attached to the frame. This constitutes a particularly simple constructive design.

There is a preferred embodiment of the invention wherein the second rear press plate is attached to the free end of a crossarm which extends out from a post, with the adjustable (the first) rear press plate being mounted on the crossarm such that said adjustable plate is closer to the post than the second plate.

There is another preferred embodiment wherein the movable rear press plate is movably attached at its bottom end, while its upper end is attached to a horizontally translatable carriage via a pivoting joint. In this way, the movable rear press plate may be adjusted very easily to differently shaped pants, since the bottom end can be moved with respect to the joint, in the horizontal direction.

There is still another preferred embodiment wherein each insertion plate and its associated hinged press plate are hinged around a common swing axis and are supported on pivots which are close to each other. By these means, it is provided, in simple and space-saving fashion, for the insertion plate and the associated hinged press plate to be swingable independently from each other, whereby the pivot of the press plate satisfies the condition that the insertion plate is accommodatable between said hinged press plate and its associated rear press plate.

BRIEF DESCRIPTION OF THE DRAWINGS

A preferred embodiment of the invention is represented in the drawings.

DESCRIPTION OF THE PREFERRED EMBODIMENT

Figure 1:
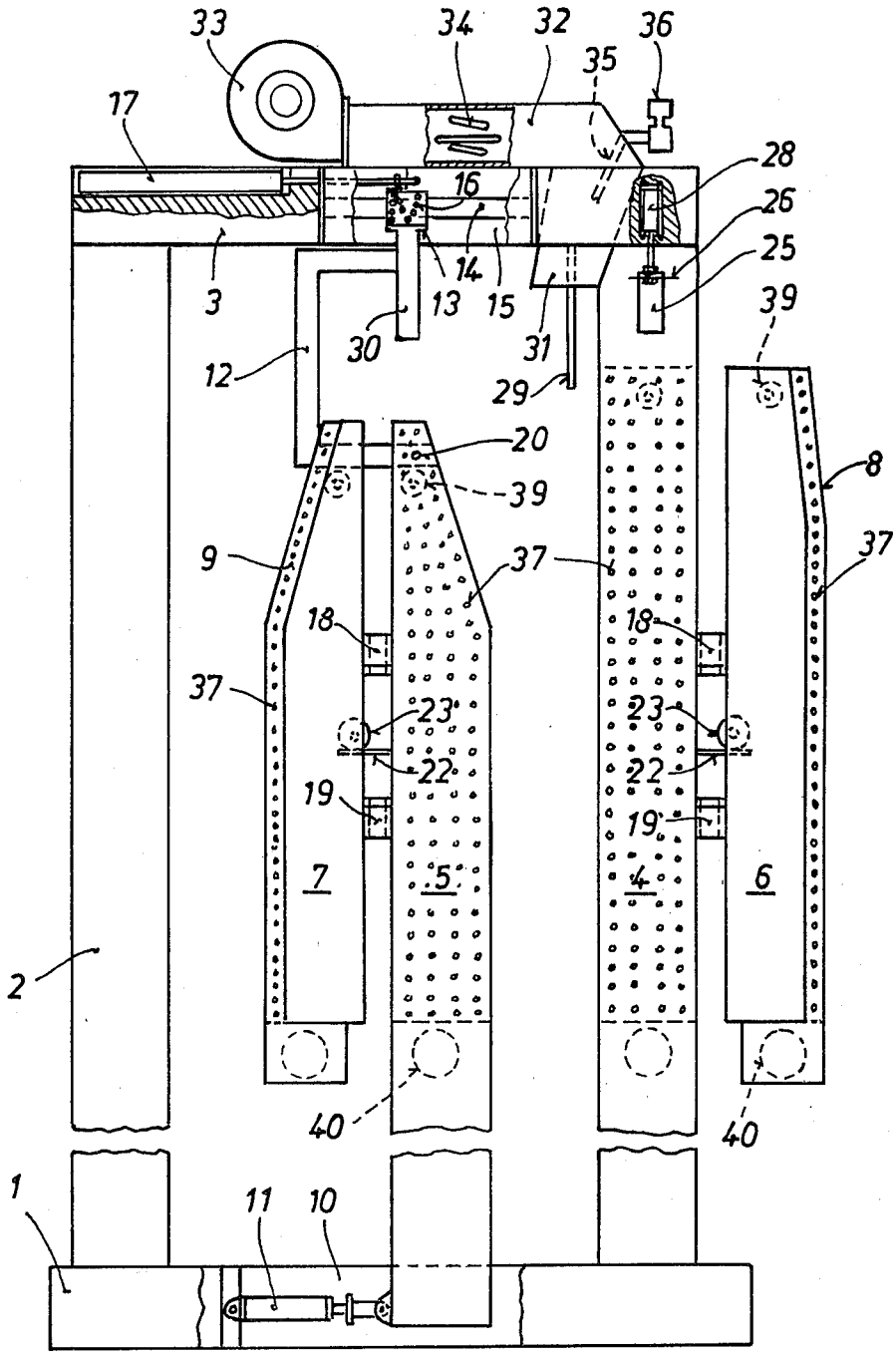
FIG. 1 shows a front view of a pants-pressing device, with said device in the "open" state.
Figure 2:
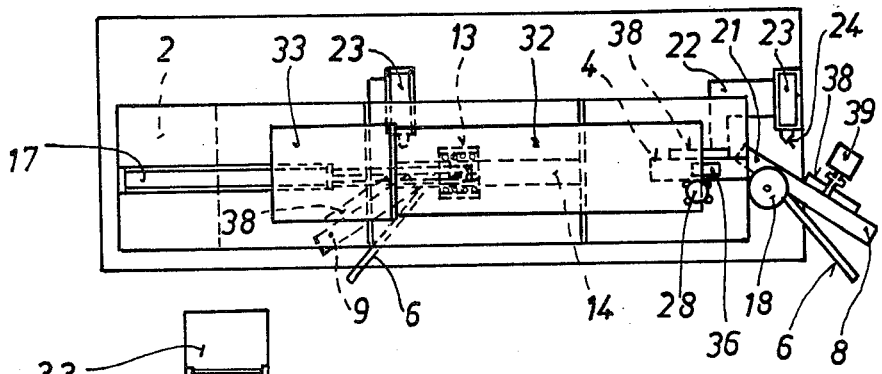
FIG. 2 shows a top view of the device of FIG. 1.

The device represented in the drawings comprises, on the bottom, a base 1 on which a vertical post 2 stands which at its top supports a crossarm 3 which extends out over base 1. There are two press plates 4 and 5 attached to this frame, and two insertion plates 6 and 7, and two hinged press plates 8 and 9; these elements and their arrangement in the frame are described below.

The one fixed press plate 4 is rigidly attached to the free end of the crossarm 3 and is also rigidly attached to the base 1. The other press plate 5 is movable horizontally at its bottom in a slot 10 in base 1, by means of, for example, a piston and cylinder assembly 11 disposed in an opening in base 1, which opening is continuous with slot 10. The top end of press plate 5 is provided at 20 on the free end of a U-bracket 12, the other end of which is attached to a carriage 13 which is horizontally movable at its top on a guide bar 14 in a recess 15 in crossarm 3. Carriage 13 is easily slidable on guide bar 14 by virtue of a ball bearing 16. The sliding is accomplished by means of a piston and cylinder assembly 17 disposed in crossarm 3.

As shown in FIG. 1, insertion plates 6 and 7 and hinged press plates 8 and 9 are pivoted on the right side of the fixed press plate 4 and the left side of the movable press plate 5, respectively, with each of these rear press plates being linked to a corresponding insertion plate (6 and 7, respectively) and a corresponding swingable press plae (8 and 9, respectively) via hinges 18 and 19. Each insertion plate (6 and 7, respectively) and each swingable press plate (8 and 9, respectively) rests on a pair of hinges 18 and 19 which is common to the respective combination of insertion plate and swingable press plate (6 and 8, or 7 and 9), whereby the insertion plate or intermediate plate (as shown in FIG. 1) is disposed forwardly when in the open position and the swingable press plate is disposed behind it. The insertion plates 6 and 7 may be swung respectively onto the fixed press plate 4 and the movable press plate 5 by hand, around a vertical axis, following which the press plates 8 and 9 may be swung onto the respective insertion plates by hand, around a vertical axis.

Each of the swingable press plates 8 and 9 has extension sections 21 which extend out over the hinges 18 and 19, said extension sections being located at the height of said hinges. There are piston and cylinder assemblies 23 attached respectively to the fixed press plate 4 and the adjustable press plate 5 by a bracket 22, at about the height of the hinges 18 and 19. The rods 24 from the pistons of assemblies 23 push against the associated extension sections 21 when the swingable press plates 4 and 5 are "closed", in order to press the pairs of press plates together.

Figure 3:
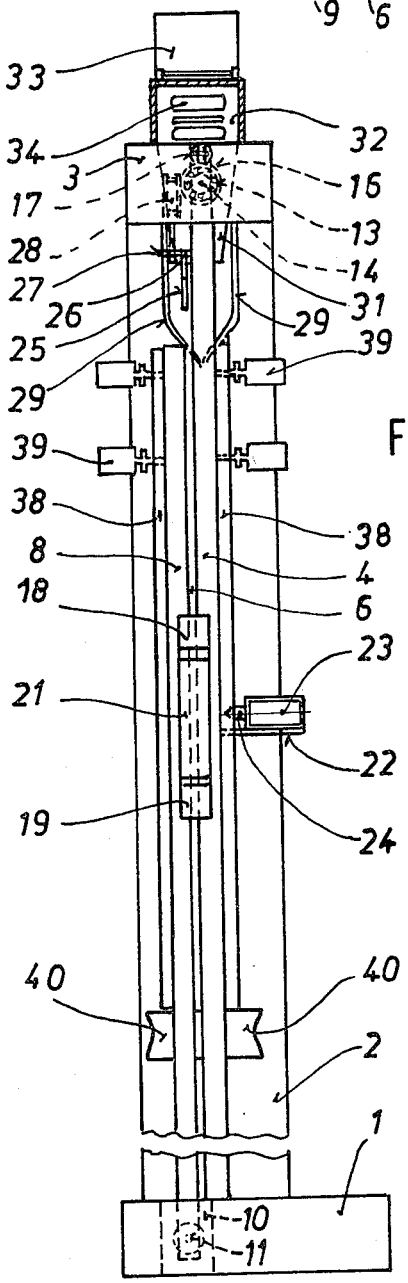
FIG. 3 shows a side view of the machine of FIG. 1, with the machine in the "closed" state.

A clamping finger 25 is swingably attached to the top end of the fixed press plate 4, such that said finger is swingable around a horizontal axis 26. A lever arm 27 which branches off perpendicularly to the clamping finger 25 is attached to a piston and cylinder assembly 28 attached to crossarm 3; and by means of this piston and cylinder assembly, the clamping finger 25 is pressed against the press plate 4. On the left of, and close to, fixed press plate 4 and clamping finger 25 (as shown in FIG. 1) there is a pair of spring wire rods 29 attached to the top to crossarm 3 and extending freely downward in a configuration as shown in FIG. 3. To the left of these a strong tensioning finger 30 extends downward from the carriage 13. This finger starts at the free end of the top arm of U-bracket 12 and ends at a distance from the outer arm.

A channel 31 extends through the two spring wire rods 29 and passes through crossarm 3. This channel 31 connects to an air blower 33 via a forechamber 32 disposed on crossarm 3. In the forechamber, there is an electrical heating arrangement 34. A delivery tube 35 for live steam opens out into channel 31 from above and is connected to a live steam pipe (not shown) via a controllable valve 36.

The insertion plates 6 and 7 or intermediate plates may be made of plastic. The press plates 4, 5, 8 and 9 are tubular with rectangular cross-sections and are provided with multiple nozzle openings 37 on one broad side over a segment as shown in the drawings. At the other broad side of each press plate, there is a steam chamber 38 running over the length of the segment with the nozzle openings 37, and said chambers are connected to a live steam pipe (not shown) and are continuously supplied with steam. There are controllable valve means 39 provided between each steam chamber 38 and its associated press plate. Each press plate 4, 5, 8 and 9 has a connecting pipe 40 which connects, via pipes not shown, to a vacuum pipe, also not shown.

In the machine, in the "open" state as in FIG. 1, the folded pants are hung by the wasitband, with said waistband being pushed over the pair of spring wire rods 29 and the forward end section of channel 31. Then the part of the waistband over the two front creases of the pants is clamped against the fixed press plate 4 by clamping finger 25. The wasitband is also pushed over tensioning finger 30 which is moved to the left until the waistband, which passes over the spring wire rod 29 and is held in the front by clamping finger 25, is taut. If the pants legs and creases are now stroked smooth, the pants are mounted and ready for pressing. The insertion plates 6 and 7 ae then closed, and the hinged press plates 8 and 9 are closed, and the pressing ensues by means of the piston and cylinder assemblies. For tensioning the width of the pants, either the lower piston and cylinder assembly 11 is used alone or it is used together with the upper piston and cylinder assembly 17. The tensioning is then concluded.

At this point, live steam is allowed to pass through the nozzle openings 37 in the press plates 4, 5, 8 and 9 for around 10 seconds. Then the supply of live steam to the press plates is interrupted and the steam is exhaused via connecting pipe 40. At the same time, hot air containing a small amount of live steam is blown into the pants via channel 31. Thereafter, the machine is reopened and the pants which have now been pressed are removed.

I claim:

1. In a device for pressing pants, in which: a frame is provided, having attached thereto means comprising a clamp and a freely extending tensioning finger which are provided on an upper crossarm for holding and stretching the pants waistband; underneath there are provided two pairs of vertically running press plates each having a front plate and a back plate which in the closed state face each other in pairs, with their broad sides being furnished with nozzle openings, by which said press plates accommodate intermediate insertion plates in the pairs; and in which there are provided pressing unit assemblies for pressing the press plates against each other in pairs, and a mechanism for tensioning the pants by translating plates in the horizontal direction with respect to each other; the improvement comprising providing that the two front press plates and the two insertion plates are hinged to swing outward in flap fashion with respect to each of the back press plates; that said pressing assemblies are disposed outside the swing region of the front press plates and the insertion plates; that for tensioning the pants one back press plate is made horizontally translatable with respect to the other back press plate; and that a clamp is associated with the broad side of the wider press plate.

2. The improvement of claim 1 wherein the bottom end of the translatable press plate extends into a slot in the base of the frame and is conncted to a piston and cylinder assembly which is disposed in the base of the frame.

3. The improvement of claim 2 wherein each front press plate projects out over its hinges with an extension section, by which the pressing assembly is attached on the one hand to the rear press plate and on the other hand engages said extension section.

4. The improvement of claim 3 wherein the translatable rear press plate is supported on a carriage which is mounted on the crossarm so as to be movable in the horizontal direction with the support of said press plate being via an intermediate piece.

5. The improvement of claim 4 wherein the tensioning finger is associated with the intermediate piece and the translatable rear press plate, while a clamp is associated with the other rear press plate.

6. The improvement of claim 1 or 5 wherein the clamp comprises the one rear non-movable press plate and a clamping finger which moves with respect to said plate.

7. The improvement of claim 6 wherein the second rear press plate is immovably attached to the frame.

8. The improvement of claim 7 wherein the second rear press plate is attached to the free end of a crossarm which extends out from a post, with the first or adjustable rear press plate being mounted on the crossarm such that said adjustable plate is closer to the post than said second plate.

9. The improvement of claim 8 wherein the movable rear press plate is movably attached on its bottom end, while its upper end is attached to a horizontally movable carriage via a pivoting joint.

10. The improvement of claim 9 wherein each insertion plate and its associated swinging press plate are hinged around a common swing axis and are supported on pivots which are close to each other.

* * * * *